US005466493A

United States Patent [19]

Mefford et al.

[11] Patent Number: 5,466,493

[45] Date of Patent: Nov. 14, 1995

[54] NON-SKID SURFACE COMPOSITION FOR PAPER PRODUCTS

[75] Inventors: John J. Mefford, Florence, Ky.; John B. Homoelle, Cincinnati, Ohio

[73] Assignee: Michelman, Inc., Cincinnati, Ohio

[21] Appl. No.: 329,446

[22] Filed: Oct. 26, 1994

[51] Int. Cl.[6] ..... C09K 3/14

[52] U.S. Cl. ..... 427/384; 427/394; 427/395; 106/36; 106/287.17; 106/287.34; 106/287.26; 106/162

[58] Field of Search ..... 106/36, 287.34, 106/287.17, 287.26, 162; 427/384, 394, 395

[56] References Cited

U.S. PATENT DOCUMENTS 4,418,111 11/1983 Carstens .

4,452,723 6/1984 Carstens .

4,980,024 12/1990 Payne et al. .

*Primary Examiner*—Mark L. Bell

*Assistant Examiner*—Michael Marcheschi

*Attorney, Agent, or Firm*—Killworth, Gottman, Hagan & Schaeff

[57] ABSTRACT

A non-skid surface composition for paper and paperboard products which is easy to apply and to clean up, which is noncorrosive and nontoxic, and which increases the coefficient of friction on the surfaces of products coated with the composition is provided. The composition does not interfere with the ability to recycle the paper to which it has been coated. The non-skid surface composition is applied as an aqueous suspension of colloidal silica or alumina with glycerine to the surfaces of a paper product.

15 Claims, No Drawings

NON-SKID SURFACE COMPOSITION FOR PAPER PRODUCTS

BACKGROUND OF THE INVENTION

This invention relates to non-skid surface compositions applied to the surface of a material to increase the surface friction. More particularly, this invention is directed to silica- or alumina-containing non-skid surface compositions applied to paper products such as paperboard and linerboard used in the manufacture of, for example, corrugated boxes, folding carton stock, communication paper packaging, and containers.

Corrugated boxes and containers, as well as other paper packaging products, are used in the shipment of a wide variety of goods. In many instances, the boxes and containers are stacked for storage and shipment, and the toppling of a stack may cause damage to the contents thereof.

Accordingly, it is desirable for the surfaces of paperboard and linerboard containers and boxes to have a high surface friction so that the stacked boxes will be less likely to shift and topple during handling. However, achieving a sufficiently high surface friction on paperboard products has been made more difficult in recent years because of the trend toward the use of recycled fiber in paper and liner board products, in some instances up to 100% recycled fibers may be used. The use of large percentages of recycled fibers in the finished paper has led to increasing problems in the handling of the paper, both in the mill and at converters, because of its increased slipperiness. This loss in the coefficient of friction is due to the shorter fibers which result from the additional processing required by recycling as compared to virgin paper fibers, as well as from contaminants introduced with the used paper. These contaminants include dirt, wax, cold set and hot melt adhesives, defoamers, water proofing, and other special coatings, etc. Various paper fiber processing techniques have been employed to remove some of these contaminants prior to paper formation but have had only marginal success in removing the wax-like contaminants which cause the paper to become slippery.

Thus, the combination of shorter recycled fibers and wax-like contaminants have had a detrimental effect on the finished linerboard coefficient of friction, or slip-angle, as it is commonly measured by the TAPPI methods T815-OM90 and T815-OM92. For instance, virgin linerboard will generally have TAPPI-method slip-angles of between 17° and 25°. Typical linerboard made with some of recycled fiber will have slip-angles of from 15° to 20°, and some boards having a high percentage of recycled fibers, and their concomitant contaminants, can have slip-angles of between 10° and 15°. Slip-angles of less than 20° have been found to be the cause of several paper and container handling problems.

One method used in the past to increase the surface friction of paperboard products has been to apply frictionizing agents to the exterior surfaces of the boxes and containers, typically by spraying the surfaces of the boxes with a frictionizing agent in a carrier or solvent. Such frictionizing agents increase the slip angle (a measure of surface friction) of the boxes.

For example, Carstens, U.S. Pat. Nos. 4,418,111 and 4,452,723, teach the use of a combination of an aqueous suspension of colloidal silica and urea as a non-skid agent. Payne et al, U.S. Pat. No. 4,980,024, teach the use of an aqueous antiskid composition which includes silica sol, 2 percent glycerine, and 5 percent polyacrylamide binder.

However, such prior art compositions have presented problems relating to application and clean up of the compositions. Accordingly, the need still exists in the art for a non-skid surface composition which is easy to apply and clean up, which is nontoxic and noncorrosive, and which does not affect the ability to recycle the paper to which it is coated.

SUMMARY OF THE INVENTION

The present invention meets that need by providing a non-skid surface composition for paper and paperboard products which is easy to apply and to clean up, which is noncorrosive and nontoxic, and which increases the coefficient of friction on the surfaces of products coated with the composition. Further, the composition does not interfere with the ability to recycle the paper to which it has been coated. The present invention also provides a coated cellulosic product and method of manufacture.

In accordance with one aspect of the present invention, a non-skid surface composition is provided and consists essentially of an aqueous suspension glycerine with at least one material selected from the group consisting of colloidal silica and alumina. Preferably, the colloidal silica or alumina has a mean particle size in the range of from about 5 to 150 nm to provide enhanced frictional characteristics to the surfaces of coated products.

In the aqueous suspension, the ratio of colloidal silica or alumina to glycerine is between about 1:1 to 5:1, and preferably about 2:1. Typically, the colloidal silica or alumina comprises from about 5 to 35% by weight based on the total (wet) weight of the composition, and the glycerine comprises from about 1 to 13% by weight based on the total (wet) weight of the composition, with the balance of the composition being water. However, depending upon the particular application, the solids content of the composition may be varied. No other components such as binders are needed. Optionally, the composition may include an additional polyol having the formula $HOCH_2(CHOH)_nCH_2OH$, where n is a number from 1 to 4, such as, for example, sorbitol, or a sugar such as, for example, sucrose or glucose.

The present invention also is directed to cellulosic products such as paperboard, linerboard, and corrugated board which are formed into boxes, bags, and other containers. By coating the surfaces of such products with the composition of the present invention, the coefficient of friction and angle of skid of these products is enhanced to provide for secure stacking and handling of these products. Also provided is a method of making such coated products which includes the steps of applying the composition to the surfaces of the products from an aqueous suspension and then evaporating the water from the coating.

Accordingly, it is a feature of the present invention to provide a non-skid surface composition for paper and paperboard products which is easy to apply and to clean up, which is noncorrosive and nontoxic, and which increases the coefficient of friction on the surfaces of products coated with the composition. This, and other features and advantages of the present invention will become apparent from the following detailed description and the appended claims.

DETAILED DESCRIPTION OF THE PREFERRED EMBODIMENT

In accordance with the present invention, the glycerine may be combined with a silica or alumina sol or colloidal suspension of silica or alumina in any convenient manner.

Thus, the glycerine may be dissolved in water and then combined with the colloidal silica or alumina sol and the concentrations of the components adjusted by proper dilution. Alternatively, the glycerine may be added directly to the sol. A typical non-skid treatment employed by many paper mills consists of spraying a dilute aqueous dispersion. of colloidal silica on the surface of the paper product. The colloidal silica solutions are frequently commercially supplied as 50% by weight dispersions. In use, these dispersions are further diluted by the end user as much as 5:1 or 6:1, resulting in a sprayable composition containing less than 10% solids (dry basis). It has been found that when the present invention is used, a lower concentration of colloidal silica or alumina may be employed to obtain equivalent or higher slip-angles than when colloidal silica or alumina alone is used. The composition of the present invention also provides good retention of the coefficient of friction and thus the slip angle for coated surfaces even after repeated slides such as would be encountered in actual use. The composition of the present invention is effective on both virgin paper fibers as well as recycled products.

While various combinations of silica and glycerine have proved suitable, it has been found that a silica or alumina to glycerine weight ratio (dry basis) of between about 1:1 to about 5:1 is most effective. While greater amounts of glycerine may be used (for a ratio of less than 1:1), performance of the composition is not further enhanced and added cost becomes a factor. The most preferred ratio, however, is between about 1:1 to 2:1.

Mean particle sizes of the colloidal silica or alumina should fall within the range of from about 5 to 150 nanometers. The preferred mean particle size comprises a range of 20 to approximately 50 nanometers. Colloidal silica and alumina are available commercially from a number of suppliers including Nalco Chemical Company, Du Pont, and Vinings Industries, Inc.

We have found that the present invention is effective with colloidal silica or alumina present in the composition in the range of from about 5 to 35% by weight, based on the total (wet) weight of the composition. Thus, the amount of colloidal silica or alumina present in the composition may vary widely depending upon the preference of the end user and the method of application of the composition to the paper product. Typical application methods include spraying, roll coating, sponge application, or use of a doctor blade.

We have also found that the amount of glycerine present in the composition should be between about 1 to 13% by weight, based on the total (wet) weight of the composition. Glycerine may be added to the composition in its substantially pure, dehydrated state, or can be added as its hydrated form, glycerol. The glycerine acts as both a humectant and a binder for the colloidal silica or alumina. No additional or separate binders need-to be added to the composition. That is, where a sufficient amount of glycerine is present in the composition as we have taught, the colloidal silica or alumina particles will remain in soluble form and not completely crystalize and harden because of the water retained by the glycerine. Yet, the particles will be firmly held to the surface of the paper product and function to increase the skid angle of papers coated with the composition.

One major disadvantage of prior art silica/urea non-skid compositions was that those compositions would dry on the hands of workers and on the application equipment used and would present significant clean-up problems including skin irritation. The composition of the present invention in its preferred form never completely dries out, remains soluble, and thus is readily cleaned from skin and applicators with just water. We have found that where the percentage of glycerine in the composition is at the upper end of the above-disclosed range, or where the glycerine to silica or alumina ratio approaches 1:1, the composition does not dry out. Thus, there is no expensive down time for laborious cleaning of equipment and no clogging of spray tips used in many spray applicators currently used in the industry. However, the use of lesser percentages of glycerine within the above-disclosed range will still provide a product which increases the skid angle of paper products to which it has been applied.

Further, where the preferred method of application is by spraying, the composition of the present invention can be applied more evenly to paper surfaces because it will not clog spray tips. Smaller diameter spray tips may be used to apply higher solids content compositions. This decreases warpage problems with the paper and requires less water to be evaporated during drying.

The composition of the present invention is relatively insensitive to pH changes. Thus, the pH of the composition may be adjusted to insure that there will be no adverse interaction of the composition with inks printed on the paper products which are coated. The composition of the present invention is nontoxic and noncorrosive. Further, it does not affect the ability of the coated paper products to be recycled.

Other optional components may be added to the composition. For example, an additional polyol having the formula $HOCH_2(CHOH)_nCH_2OH$, where n is a number from 1 to 4, such as, for example, sorbitol may be added in amount of from about 0 to 10% by weight, based on the total (wet) weight of the composition. Such a polyol may be in addition to the glycerine in the composition or as a partial replacement for the glycerine. Alternatively, a sugar such as, for example, sucrose or glucose may be added to the composition. Small amounts (less than 0.5%) of bactericides or the like may also be added.

In order that the invention may be more readily understood, reference is made to the following examples, which are intended to be illustrative of the invention, but are not intended to be limiting in scope.

EXAMPLE 1

A colloidal silica/glycerine composition was prepared to yield the following concentrations (percentage by wet weight):

| | |
|---|---|
| Silica[1] | 33.50% |
| Glycerine | 8.59% |
| Proxel ®[2] | 0.10% |
| Water | 57.81% |

[1]50% solids colloidal suspension
[2]Bactericide, from ICI Americas, Inc.

The composition provided a 2:1 weight ratio (dry basis) of silica to glycerine.

The composition was coated using a blade onto a relatively smooth piece of 42 pound kraft liner board. The liner board was cut into two pieces and the coated surfaces were placed face to face in the same machine direction. The angle of skid between the two coated pieces was measured using the TAPPI procedure T815 OM-92. The results are reported below, with successive test numbers representing successive tests to determine not only the angle of skid but also whether the angle would drop off with repeated skid testing.

| Test Run # | Angle of Skid |
|---|---|
| 1 | 34.0° |
| 2 | 32.0 |
| 3 | 32.5 |
| 4 | 31.5 |
| 5 | 30.0 |
| 6 | 32.0 |
| 7 | 32.0 |
| 8 | 32.0 |
| 9 | 32.0 |
| 10 | 32.5 |

The average angle of skid was 32.05, with a standard deviation (σ–1) of 0.98. The decrease in angle of skid from first to last test run was 1.5°. Such a decrease was well within statistical variation to be able to infer that there was no significant drop in the coefficient of friction on the liner board surface.

EXAMPLE 2

A second colloidal silica/glycerine composition was prepared to yield the following concentrations (percentage by wet weight):

| | |
|---|---|
| Silica[1] | 25.00% |
| Glycerine | 13.02% |
| Proxel ®[2] | 0.10% |
| Water | 61.88% |

[1]50% solids colloidal suspension
[2]Bactericide, from ICI Americas, Inc.

The composition provided a 1:1 weight ratio (dry basis) of silica to glycerine. When the water was evaporated from a small portion of the sample, the solids (silica and glycerine) remained in liquid form, and the silica did not crystallize or harden.

The composition was coated and then tested as described in Example 1. The results are reported below, with successive test numbers representing successive tests.

| Test Run # | Angle of Skid |
|---|---|
| 1 | 34.5° |
| 2 | 32.5 |
| 3 | 33.0 |
| 4 | 32.5 |
| 5 | 33.0 |
| 6 | 33.5 |
| 7 | 32.5 |
| 8 | 33.0 |
| 9 | 31.5 |
| 10 | 31.5 |

The average angle of skid was 32.75, with a standard deviation (σ–1) of 0.89. The decrease in angle of skid from first to last test run was 3.0°.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A non-skid surface composition consisting essentially of an aqueous suspension of glycerine with at least one material selected from the group consisting of colloidal silica and alumina, and wherein the ratio of said material to glycerine is between about 1:1 to 5:1.

2. A composition as claimed in claim 1 wherein said material has a mean particle size in the range of from about 5 to 150 nm.

3. A composition as claimed in claim 1 wherein the ratio of said material to glycerine is about 2:1.

4. A composition as claimed in claim 1 wherein said material comprises from about 5 to 35% by weight based on the total weight of the composition.

5. A composition as claimed in claim 1 wherein said glycerine comprises from about 1 to 13% by weight based on the total weight of the composition.

6. A composition as claimed in claim 1 further including a polyol having the formula $HOCH_2(CHOH)_nCH_2OH$, where n is a number from 1 to 4.

7. A composition as claimed in claim 6 in which said polyol is sorbitol.

8. A composition as claimed in claim 1 further including a sugar.

9. A method of increasing the coefficient of friction of the surface of a cellulosic substrate comprising the steps of applying a non-skid surface composition consisting essentially of an aqueous suspension of glycerine with at least one material selected from the group consisting of colloidal silica and alumina, and wherein the ratio of said material to glycerine is between about 1:1 to 5:1, to the surface of said substrate and evaporating the water therefrom.

10. A method as claimed in claim 9 in which said cellulosic substrate is a paper product containing at least 15% by weight recycled paper fibers.

11. A method as claimed in claim 9 wherein said colloidal silica or alumina has a mean particle size in the range of from about 5 to 150 nm.

12. A method as claimed in claim 9 wherein the ratio of said material to glycerine is about 2:1.

13. A method as claimed in claim 9 wherein said material comprises from about 5 to 35% by weight based on the total weight of the composition.

14. A method as claimed in claim 9 wherein said glycerine comprises from about 1 to 13% by weight based on the total weight of the composition.

15. A method as claimed in claim 9 further including a polyol having the formula $HOCH_2(CHOH)_nCH_2OH$, where n is a number from 1 to 4.

* * * * *